United States Patent [19]

Goldenberg

[11] 4,363,200

[45] Dec. 14, 1982

[54] PRE-CAST BUILDING ELEMENT AND METHOD

[75] Inventor: Joseph Goldenberg, Hyattsville, Md.

[73] Assignee: Construction Products Research and Development Corporation, Reno, Nev.

[21] Appl. No.: 179,563

[22] Filed: Aug. 19, 1980

[51] Int. Cl.[3] ..... E04B 1/00

[52] U.S. Cl. ..... 52/251; 52/252; 52/741; 52/322; 52/600

[58] Field of Search ..... 52/250, 251, 252, 253, 52/259, 602, 741, 322, 335, 438, 722, 723, 260, 340, 600; 264/31, 34

[56] References Cited

U.S. PATENT DOCUMENTS

| | | | |
|---|---|---|---|
| 2,618,146 | 11/1952 | Ciarlini | 52/252 |
| 3,864,888 | 2/1975 | Tupper et al. | 52/741 |
| 3,867,805 | 2/1975 | Mikami et al. | 52/259 X |
| 3,885,369 | 5/1975 | Ott | 52/340 X |
| 4,081,935 | 4/1978 | Wise | 52/252 X |
| 4,211,045 | 7/1980 | Koizumi et al. | 52/251 |

FOREIGN PATENT DOCUMENTS

| | | | |
|---|---|---|---|
| 2366412 | 4/1978 | France | 52/252 |
| 2387325 | 12/1978 | France | 52/251 |

*Primary Examiner*—Price C. Faw, Jr.
*Assistant Examiner*—Carl D. Friedman
*Attorney, Agent, or Firm*—Cushman, Darby & Cushman

[57] ABSTRACT

A precast beam for use in constructing a building includes a substantially flat middle portion extending the length of the beam and upstanding sidewalls on either side of the middle portion defining a trough which also extends the length of the beam; the trough is open at each end of the beam and the beam is provided with tensioned reinforcing rods in the middle portion along its length and a plurality of stress relieving slits spaced along the upstanding sidewalls to prevent camber developing; the reinforcing rods of the beam protrude a selected distance from the ends of the beam; a method of construction is disclosed where forms for the vertical components are set in place, the precast beam is then set in place before the cementitious material is poured into the forms for the vertical components whereby the installation and proper orientation of the reinforcing rods of the precast beam and the flooring as well as the reinforcing rods of the vertical components can be obtained.

13 Claims, 6 Drawing Figures

PRE-CAST BUILDING ELEMENT AND METHOD

BACKGROUND AND SUMMARY OF THE INVENTION

The present invention relates to a novel precast beam for use in constructing buildings of cementitious material where reinforcing steel rods are employed to impart strength to the resulting structure. Also, a novel method of constructing a building incorporating the precast beams of the present invention is also disclosed.

In the past, the use of precast concrete structures incorporating reinforcing steel rods has suffered from the disadvantage that the precast elements have been very expensive to manufacture and set in place in view of the close tolerances that must be observed in erecting the structure. In many instances, where the tolerances have not been observed, on site modification of the precast elements has been required which causes further delay and increased costs. In other arrangements, elaborate joining elements including welded joints have had to be employed to effect assembly of the precast elements. Not only do such devices consume valuable construction time, but also they have often materially contributed to the cost of the already expensive precast elements. In some instances, where close supervision of the construction crews has not been provided, the construction crews have been known to sever a portion of the reinforcing rods of the precast elements in order to effect installation of these elements. This obviously has the undesirable, if not dangerous, effect that the resulting structure's integrity is weakened so that subsequent separation of the precast elements can and has occurred when the walls and foundation of the building settle in the earth.

In addition to the problem of effecting structural cooperation between the reinforcing elements of the precast beams and reinforcing elements of other concrete portions of the structure that are not precast, the precast elements of the prior art have been very difficult and expensive to transport and erect, particularly where they are being employed in large structures such as office buildings, parking structures, warehouses and the like. This feature has severely limited the utility of concrete precast elements in the building trade.

The present invention overcomes the foregoing drawbacks by providing a precast element and method of use of the precast element that insures substantially increased structural integrity for the resulting structure and one which is particularly useful in connection with flooring systems that are presently in use which factor will also materially reduce building costs.

In summary, the precast element of the present invention is in the form of a spanning beam which, in one embodiment, is substantially U-shaped in cross-section having relatively short upstanding legs and a base middle portion of suitable length and width, the dimensions being dependent upon the particular design of the structure in which the precast element is to be incorporated. Reinforcing rods are embedded in the middle portion of the beam at a selected location to impart great strength to the precast beam. The middle portion together with the upstanding sidewalls which extend the length of the beam define a trough for receiving cementitious material when the floor of the structure incorporating the beam of the present invention is poured. To eliminate any camber in such beams that are reinforced with prestressing rods or tendons, relieving means in the form of slits are provided in the upstanding sidewalls of each beam at spaced intervals whereby the weight of the beam in cooperation with the relieving means will assure that the beam lies flat. Stirrups are also cast into the beam and project into the trough to assure firm bonding and to act as a mechanism to transfer shear from the later added cementitious material to the already precast cement of the beam. The reinforcing rods that are embedded into the precast trough section or midsection of the beam protrude from the ends of the beam to enable suitable connection with the after poured cement of the structure being erected.

The present invention also embraces a new method of construction which preferably utilizes the precast beam of the present invention. More specifically, as distinct from the conventional practice of setting up forms for the vertical components and pouring the cement in the vertical forms, according to the present invention, the forms for the vertical components such as the columns or walls, as the case may be, are set up and then the precast beams of the present invention or other suitable precast beams are set in place on top of the vertical forms. This has the advantage of allowing workers to easily adjust the disposition of the reinforcing elements of the precast beam together with the reinforcing elements that are inserted into the vertical forms and which are employed to give strength and rigidity to the vertical components themselves. By way of example, with the vertical forms erected, the precast beams are set over the top of the vertical forms to span the distance between two vertical forms or, if desired, to provide for a cantilevered disposition of the beam. The reinforcing rods of the precast beam and the vertical components can be intertwined before concrete is poured into the trough of the precast beam and the vertical forms. Also, additional reinforcing elements may be laid across the vertical component so as to provide continuity between the ends of adjacent precast beams which will develop the required structural continuity and also develop moment connections to resist wind and seismic load. This provides a simple and economical means of accomplishing difficult structural moment connections and avoids the necessity of employing complicated and expensive joining elements for the precast beams. Also, other precast elements or portions of the structure may be connected to the precast beam by laying across reinforcing elements between the trough area of the precast beam and the reinforcing members of such other structural elements.

When the flooring forms are set in place such as those presently in use, cementitious material is poured over the forms including into the trough of the precast beams and into the vertical form so that, after curing, a unitary structure of great strength and integrity is obtained. While the method of the present invention is particularly useful with the precast beam of the present invention, it is apparent that other types of precast beams having reinforcing elements protruding therefrom may be employed.

Other advantages of the present invention will become apparent as consideration is given to the following detailed description taken in conjunction with the accompanying drawings, in which:

DETAILED DESCRIPTION OF THE INVENTION

Figure 1:
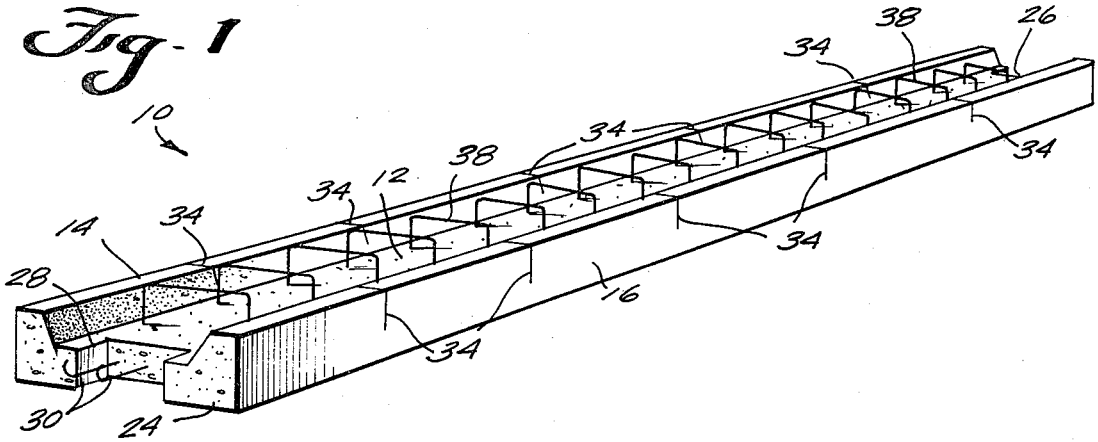
FIGS. 1 and 2 are views of the precast beam of the present invention.
Figure 2:
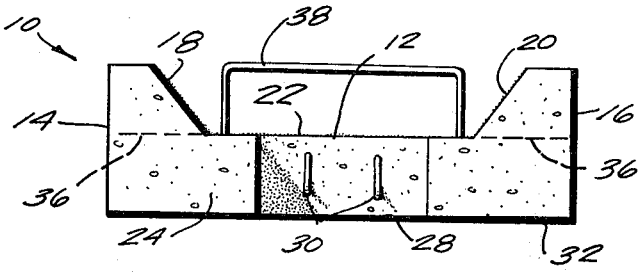

Referring to the drawings wherein like numerals designate corresponding parts throughout the several views, there is illustrated in FIGS. 1 and 2 a perspective and end view, respectively, of the precast beam 10 of the present invention. As previously noted, the beam may be constructed to have a length sufficient to span the distance between vertical wall components of a structure such as walls or columns and to cantilever beyond when desired. The beam of the present invention is particularly useful in warehouse, offices and garage concrete structures where such spans may extend to as much as 60 feet, or beyond. The width of the beam 10 may also be selected to be compatible with conventional engineering practices and the design of the structure into which the beam is to be incorporated and it will be understood that the illustrated dimensional relationships are by way of example only.

An important aspect of the present invention resides in the cross-section structure of the beam 10 wherein there is provided a flat midportion 12 along the length of the beam side walls 14 and 16 which extend generally perpendicularly from the midportion 12 on either side thereof and which also extend the length of the beam 10.

As shown more clearly in FIG. 2, each of the side walls 14 and 16 may be provided with inwardly slanting surfaces 18 and 20 which simplifies forming and stripping during production. The walls 14 and 16 define side walls of the trough area 22 which is open at the opposite ends 24 and 26 of the beam 10. A unique feature of the beam of the present invention is that the top of the sides 14 and 16 are smooth to enable easy movement of the flooring elements 46 to their exact location. The other surfaces 12, 18 and 20 are roughened for better bonding with the subsequently poured cementitious material. In addition, at each end, a recess or notch, one of which is shown at 28, can be provided and into which extends the ends of reinforcing rods 30 which extend the length of the beam 10 and out the opposite end 26. The provision of the recess 28 is particularly useful in establishing cooperation between the reinforcing elements of the beams and vertical form components. However, there are, of course, a number of structural designs where such cooperation is not required so that the precast beams for such applications would not be provided with such a recess at its ends.

The reinforcing rods or prestressing tendons or strands 30 are laid in the original forms for the beam 10 at a point as close to the bottom surface 32 as permitted for fire protection as dictated by the appropriate building codes. Preferably, the thickness of the midportion 12 is at least five inches and the rods 30 are at least one-half inch below the midpoint of the thickness of the midportion 12. It will be understood that, while only two reinforcing rods 30 are illustrated, any number of such elements may be employed as is conventional in this art and which depends upon the width and span of the beam selected. It has been found that an efficient reinforcement of the precast beam 10 is achieved by placing the reinforcing tendons 30 as described above. However, by placing the tendons 30 thusly, the beam 10 exhibits a camber from end to end due to the tension on the tendons 30. To remove this camber, the present invention provides a plurality of spaced slits 34 in each of the side walls 14 and 16 with the slits penetrating to the top level of the midportion 12 as shown by the broken lines 36 in FIG. 2. The slits 34 act as relieving means to compensate for the eccentric placement of the tendons 30 so that any camber in the beam 10 will be voided by the weight of the beam itself.

Figure 6:
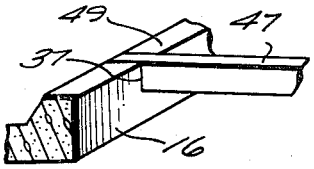
FIG. 6 is a perspective view with parts broken away of another form of the beam of the present invention.

As a further refinement, as shown in FIG. 6, in addition to the slits, recesses 37 may be provided, if desired, to receive the end of joist elements 47 whereby the joist element will lie flush with the top 49 of the supporting side wall 16.

The previously described trough area 22 is provided to receive cementitious material after the beam 10 is placed in location on a form structure. To assure firm bonding and to provide a mechanism to transfer shear forces between the afterpoured cement of the floor and the beam 10, welded wire fabric or mesh, bent bars may extend from the forms of the floor into the trough area 22 where metal rods 38 sometimes referred to as stirrups are embedded into the concrete of the beam 10 when the beam is formed.

With the beam as thus far described, it will be apparent that the overall weight of the precast beam is significantly reduced by providing the trough area 22 thus facilitating transport and setting in place of the beams.

The construction sequence using the method of the present invention will now be described in conjunction with FIGS. 3–5 and, while the following description will refer to the beam 10 as described above, it should be understood that other types of precast beams may be employed and that the beam 10 of the present invention is a preferred element in this method.

Figure 3:
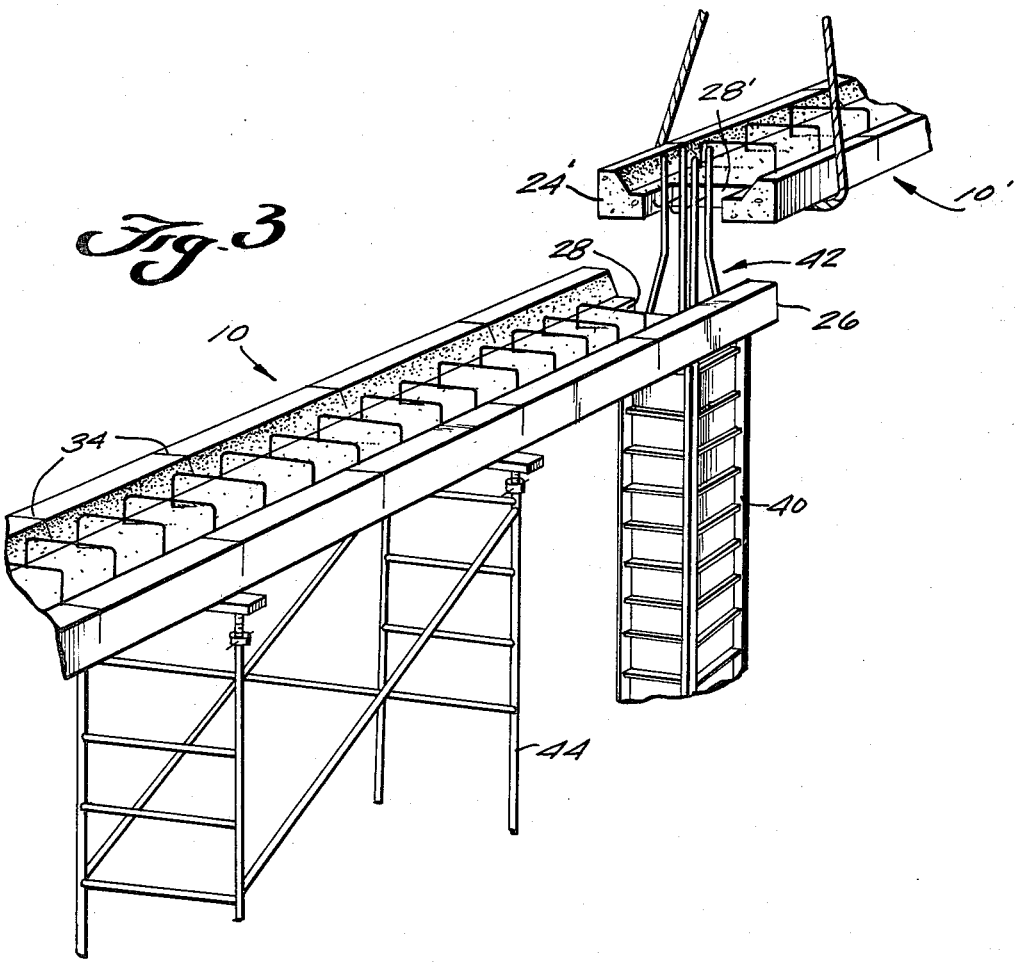
FIG. 3 is a perspective view showing the precast beams of the present invention being placed in position on a vertical form component.

Referring now to FIG. 3, the construction sequence commences after the foundation is poured. Then, forms for the vertical components of the structure, such as walls or columns, are erected on the foundation. For example, in FIG. 3, a form 40 for a vertical column is erected and which includes reinforcing rods 42 which protrude from the uppermost portion of the form 40. Scaffolding 44 or other conventional shoring equipment is erected and the beam 10 is set in place so that one end 26 will lie above the edge or perimeter of the upper end of the form 40. An identical beam 10' is then lowered in place, to be supported on similar scaffolding or shoring (not shown) so that the abutting ends 26 and 24' will assume the positions illustrated in FIG. 4 and more clearly in FIG. 5.

Figure 4:
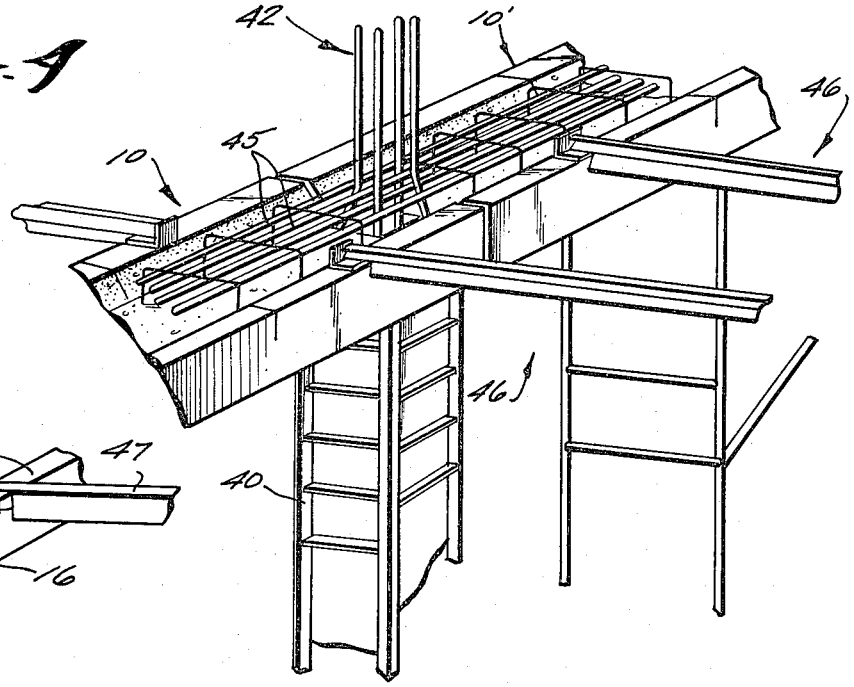
FIG. 4 is a perspective view illustrating the disposition of reinforcing rods relative to the precast beams, the vertical form and the floor form elements prior to the pouring of the cementitious material.
Figure 5:
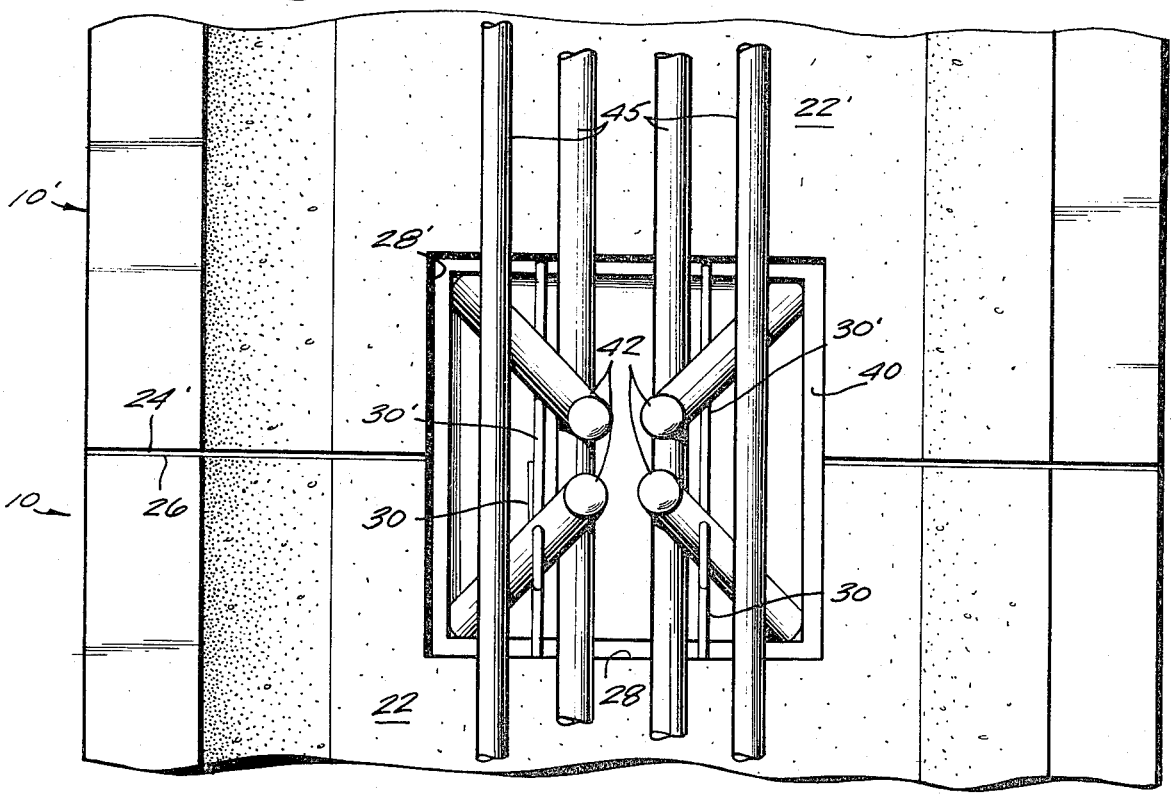
FIG. 5 is a detailed plan view showing the disposition of the reinforcing elements prior to the pouring of the cementitious material.

Referring to FIG. 4, with the beams 10 and 10' in place and supported by suitable scaffolding, reinforcing rods 45 are disposed across the abutting ends of the beams to be intertwined with the reinforcing rods 42 protruding from the interior of the form 40. While the illustrated arrangement of the reinforcing rods 42 and 45 is by way of example, it will be understood that more intricate interweaving of the reinforcing elements may be effected, as is desired and dictated by the requirements for the particular structure being erected.

In general, grouting is unnecessary as any space between the abutting ends of the beams 10 and 10' will be filled with the afterpoured concrete thus resulting in a material saving in construction time. Thereafter, suitable secondary precast or poured in place elements, forms for other support structures or the like such as indicated at 46 for supporting forms for the horizontal components of the structure may be provided to span the distances between the primary precast beams of the present invention. For clarity's sake, in the drawings, the flat panels which constitute a major portion of the forms for the horizontal surfaces or other types of secondary or in-fill support structures are omitted.

With the foregoing arrangement, the reinforcing steel rods 42 of the vertical components can be disposed to cooperate intimately with the horizontal reinforcing steel rods 45 as well as the tendons 30 and 30' of the precast beams to assure not only the accurate placement of the precast beams 10 and 10' with respect to the vertical components of the structure but also to assure excellent and uniform bonding between the reinforcing elements of the vertical and horizontal components so that a resulting structure of great integrity and strength will be achieved.

After the precast beams have been set in place and the various reinforcing elements have been properly adjusted, cementitious material such as concrete is poured over the forms to form the floors and into the trough areas 22 and 22' and into the vertical form 40. After the cementitious material has cured, a composite, homogeneous, monolithic and unitary structure is achieved where the precast beams are bonded not only to the adjacent flooring but also to the vertical components whether columns or walls. As will be apparent to those skilled in the art, the pouring may be effected first by filling the vertical forms and to the top of the midportion 12 of the beams prior to pouring the slab areas constituting the horizontal floors of the structure.

A significant advantage with the use of a precast beam and a light horizontal infill floor system 46 according to the present invention is that column spacing can be increased due to the greater strength and minimal deflections of the precast beam and, consequently the number of the columns may be reduced resulting in more usable space, and less costly footing upon which the structure is built.

In addition, reinforcing, such as welded wire fabric, mesh or steel bars of the flooring system can be embedded into the concrete poured into the trough area of the precast beams to effect a strong lateral connection between the floor concrete and the precast beams thereby materially contributing to the strength of the resulting structure. In a similar fashion, the precast beams of the present invention can be connected with other precast elements used in a structure by incorporating linking elements such as the reinforcing rods mentioned above with the concrete that is poured into the trough area of the precast beams of the present invention.

As a result of the homogeneous structure obtained by the method of the present invention used in connection with the beam of the present invention, a much stronger resulting structure is obtained at less cost due to the much greater simplicity in effecting connection between the precast beams and the in-situ formed portions of the structure and, consequently, substantial savings in costs result because structural walls customarily required in the present precast systems to transfer horizontal forces from wind and seismic conditions and the like are eliminated by the present invention.

Having described the invention, it will be apparent to those skilled in this art that various modifications may be made thereto without departing from the spirit and scope of the present invention as defined in the appended claims.

What is claimed is:

1. A method of forming a building structure of the type having a plurality of substantially vertical components of cast cementitious material for supporting a horizontal surface of the structure comprising the steps of:

erecting a plurality of forms for the vertical components at selected spaced locations, with the forms including reinforcing means for cementitious material protruding from the top of at least some of the forms, disposing precast beam means so as to span the space between at least some of the adjacent forms for the vertical components, adjusting the reinforcing means of the forms for the vertical components to a selected condition to cooperate with additional reinforcing means associated with the precast beam member, filling the forms for the vertical components with cementitious material to a level sufficient to cover both said reinforcing means at least in the area where said means are adjusted to cooperate, and after curing of the cementitious material, removing said forms from the cast vertical components.

2. The method as claimed in claim 1 wherein the reinforcing means of the forms and the additional reinforcing means associated with the precast beam means are rods and the step of adjusting the reinforcing means includes the step of aligning the rods associated with the precast beam means so as to intersect the rods of the forms in a selected pattern.

3. The method as claimed in claims 1 or 2 wherein the precast beam means includes opposite ends and reinforcing means embedded therein with a portion thereof protruding from said ends and including the steps of interposing said portions with the reinforcing means of the forms prior to filling the forms and covering said portions with the cementitious material upon filling the forms.

4. The method as claimed in claims 1 or 2 wherein the precast beam means is of a type having an elongated base section and generally parallel side walls extending generally perpendicular to said base section along the length of the base section so as to define a trough area, and including the step of filling the trough area with cementitious material after the reinforcing means have been adjusted.

5. The method as claimed in claim 4, including the step of placing the ends of two precast beam means in contiguous relation over a form for a vertical component so that the trough areas of the two beam members are in alignment with respect to each other and, prior to filling the trough areas with cementitious material, laying reinforcing means in the trough areas across the junction of the two beam means.

6. The method as claimed in claims 1 or 2 wherein the precast beam means is of a type having an elongated base section and generally parallel side walls extending generally perpendicular to said base section along the length of the base section so as to define a trough area, and including the step of disposing slab forms between adjacent beam means and filling the trough area and slab forms with cementitious material to form a horizontal surface of the structure.

7. A precast member for use in a building structure comprising a substantially flat middle portion extending the length of said member and side wall means extending generally perpendicular to said middle portion on opposite sides thereof along a substantial length of said member, said side wall means defining a trough for receiving cementitious material therein, said flat middle portion having rod means protruding generally vertically therefrom at spaced intervals along the length of said middle portion in said trough defined by said side walls means, said flat middle portion incorporating reinforcing means embedded therein which protrude from the opposite ends of said middle portion, said reinforcing means being metal rods which are prestressed, said flat middle portion having oppositely facing surfaces with said reinforcing rods lying closer to one of said surfaces relative to the other surface, said member further including relieving means to prevent the development of camber in said member, said relieving means being slits formed generally perpendicularly to said flat middle portion in said side walls at spaced apart intervals.

8. The precast member as claimed in claim 7 wherein said precast member has at its opposite ends recesses for cooperating with forms for receiving cementitious material.

9. The precast member as claimed in claim 7 wherein said member is made of cementitious material.

10. The precast member as claimed in claim 7 wherein one of said surfaces is more remote from said side walls than the other of said surfaces and said metal rods are closer to said more remote of said surfaces.

11. The precast member as claimed in claim 7 wherein said side walls have spaced channel means therein each for receiving the end of a joist member whereby the joist member will lie flush with the top of a said side wall.

12. A structure of the type including vertical components and including precast members extending between at least some of said vertical components, said precast members being of the type defined in claim 7.

13. A precast member for use in a building structure comprising a substantially flat middle portion extending the length of said member and side walls extending generally perpendicular to said middle portion on opposite sides thereof along a substantial portion of the length of said member, said flat middle portion incorporating reinforcing means embedded therein which protrude from the opposite ends of said middle portion, said reinforcing means being metal rods which are prestressed, said flat middle portion having oppositely facing surfaces and with said reinforcing rods lying closer to one of said surfaces relative to the other surface, said member further including relieving means to prevent the development of camber in said member, said relieving means being slits formed generally perpendicular to said flat middle portion in said side walls at spaced apart intervals.

* * * * *